US006383063B1

(12) United States Patent
Ohashi et al.

(10) Patent No.: US 6,383,063 B1
(45) Date of Patent: May 7, 2002

(54) POLISHING APPARATUS AND POLISHING METHOD

(75) Inventors: Yuji Ohashi, Nagoya; Kazuo Kiriyama, Aichi, both of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/555,610

(22) PCT Filed: Mar. 30, 1999

(86) PCT No.: PCT/JP99/01645

§ 371 Date: May 31, 2000

§ 102(e) Date: May 31, 2000

(87) PCT Pub. No.: WO99/51396

PCT Pub. Date: Oct. 14, 1999

(30) Foreign Application Priority Data

Apr. 3, 1998 (JP) ..... 10-91543

(51) Int. Cl.[7] ..... B24B 21/00

(52) U.S. Cl. ..... 451/303; 451/307

(58) Field of Search ..... 451/8, 11, 303, 451/307, 313, 317, 318, 489, 24, 40, 49, 62

(56) References Cited

U.S. PATENT DOCUMENTS

| | | | | |
|---|---|---|---|---|
| 4,833,834 A | * | 5/1989 | Patterson et al. | 451/310 |
| 4,993,191 A | | 2/1991 | Judge et al. | |
| 4,999,953 A | | 3/1991 | Kinugawa et al. | |
| 5,065,548 A | | 11/1991 | Shimizu | |
| 5,088,240 A | | 2/1992 | Ruble et al. | |
| 5,371,973 A | * | 12/1994 | Kaiser, Jr. et al. | 451/62 |
| 5,437,125 A | | 8/1995 | Barton, II | |
| 5,531,631 A | | 7/1996 | Judge | |
| 5,536,201 A | | 7/1996 | Windelmann | |
| 5,651,719 A | | 7/1997 | Pineau | |

FOREIGN PATENT DOCUMENTS

| | | |
|---|---|---|
| DE | 196 50 155 C1 | 6/1998 |
| EP | 0 349 653 A1 | 1/1990 |
| EP | 0 366 506 A1 | 5/1990 |
| EP | 0 434 533 A1 | 6/1991 |
| JP | A-60-7952 | 1/1985 |
| JP | A-61-209457 | 9/1986 |
| JP | A-1-307920 | 12/1989 |
| JP | A-3-1168 | 1/1991 |
| JP | A-3-88657 | 9/1991 |
| JP | A-3-251358 | 11/1991 |
| JP | A-5-8163 | 1/1993 |
| JP | A-5-169361 | 7/1993 |
| JP | A-6-55430 | 3/1994 |
| JP | A-7-60631 | 3/1995 |
| JP | A-7-75953 | 3/1995 |
| JP | A-8-19950 | 1/1996 |
| JP | A-8-257899 | 10/1996 |
| JP | A-9-136257 | 5/1997 |

* cited by examiner

*Primary Examiner*—Derris H. Banks
(74) *Attorney, Agent, or Firm*—Oliff & Berridge, PLC

(57) ABSTRACT

In an apparatus for polishing a workpiece, by rotating the workpiece while pressing a press member against a back surface of a polishing tape and thereby pressing the polishing tape against the workpiece, a cartridge 72 which holds the press member 96 is provided, for improving the ability of the press member to follow the workpiece, with a rollable-type holding device 260 which holds the press member 96 such that the press member 96 is rollable about a rolling axis line $L_S$ which perpendicularly crosses, in a three-dimensional space, over a rotational axis line about which the workpiece 10 is rotated. During the polishing of the workpiece, the press member 96 is rolled relative to the cartridge 72, so that the press member 96 follows the workpiece 10.

18 Claims, 11 Drawing Sheets

POLISHING APPARATUS AND POLISHING METHOD

TECHNICAL FIELD

The present invention relates to the art of polishing a workpiece with a polishing tape.

1. Background Art

Japanese Patent Document. TOKU-KAI-HEI 8-257899 discloses an example of the art of polishing a workpiece with a polishing tape. This prior art realates to the art of polishing a workpiece, by rotating the workpiece while pressing a press member against a back surface of a polishing tape and thereby pressing the polishing tape against the workpiece.

In the prior art, "an axis line about which a workpiece is rotated" may, or may not, coincide with an axis line of a target portion of the workpiece that is to be polished. For example, in the case where a camshaft of an engine is a workpiece and a cam surface of a cam portion of the camshaft is a target surface of the target portion that is to be polished, "an axis line of rotation of the workpiece" coincides with an axis line of the target portion. However, in the case where a crankshaft of an engine is a workpiece and an outer surface of a pin-like portion as a connection portion of the crankshaft that is to be connected to a connecting rod is a target surface, "an axis line of rotation of the workpiece" does not coincide with an axis line of the target portion.

2. Disclosure of Invention

In the prior art, the press member is movable along a straight line which crosses the rotation axis line of the workpiece. However, in the prior art, the press member cannot do any other sort of motion. Therefore, in the case where an angle defined by the target surface and the rotation axis line of the workpiece changes in a direction in which the target surface continues, the press member cannot follow the workpiece. Thus, the shape of the workpiece the press member can follow is limited.

The present invention has been developed in the above-indicated background, and an object thereof is to improve the ability of a press member to follow a workpiece.

The above-indicated object is achieved according to each of the following features of the present invention. These features are given respective sequential numbers and are described in the same manner as that in which claims are described, i.e., any feature that includes another feature shall do so by referring to the number given to the latter feature. This is for helping more easily understand that two or more of the following features may be combined.

(1) An apparatus for polishing a workpiece, by rotating the workpiece while pressing a press member against a back surface of a polishing tape and thereby pressing the polishing tape against the workpiece, the apparatus being characterized in that the apparatus includes a holding portion which holds the press member, and the holding portion includes a rollable-type holding device which holds the press member such that the press member is rollable about a rolling axis line which crosses a rotation axis line about which the workpiece is rotated.

In this apparatus, the press member is rollable about a rolling axis line which crosses the rotation axis line of the workpiece. Therefore, in this apparatus, the press member can follow the workpiece not only in the case where the angle defined by the target surface and the rotation axis line of the workpiece does not change in the direction in which the target surface continues but also in the case where the angle changes.

In addition, in this apparatus, the press member is made rollable relative to the rotation axis line of the workpiece, because the press member is made rollable relative to the holding portion of the apparatus. Therefore, as compared with the case where both the press member and the holding portion are made rollable relative to the rotation axis line of the workpiece, inertia which resists the rolling of the press member can be decreased, which also contributes to improving the ability of the press member to follow the workpiece.

In this apparatus, "the rotation axis line about which the workpiece is rotated" may or may not, coincide with an axis line of the above-indicated target portion.

In addition, the phrase of "a rolling axis line which crosses a rotation axis line about which the workpiece is rotated" means not only the case where the rolling axis line intersects the rotation axis line but also the case where the rolling axis line does not intersect the rotation axis line, i.e., crosses over the rotation axis line in a three-dimensional space.

(2) An apparatus according to the feature (1), wherein the rolling axis line is substantially parallel to a straight line which contacts a contact surface of the press member that contacts the workpiece, at a position corresponding to a contact position where the polishing tape contacts the workpiece, and which perpendicularly crosses over the rotation axis line of the workpiece in a three-dimensional space.

(3) An apparatus according to the feature (1) or (2), wherein the rolling axis line is located it a position about which, during the polishing of the workpiece, a moment which rolls the press member to follow the workpiece is produced by a force which is exerted by the workpiece to the press member.

This apparatus does not essentially need a device which produces a force to roll the press member, and exerts the force to the press member so that the press member can follow the workpiece. Thus, the ability of the press member to follow the workpiece can be improved w*without complicating the construction of the polishing apparatus.

(4) An apparatus according to any one of the features (1) to (3), wherein the rolling axis line substantially coincides with a straight line which contacts a contact surface of the press member that contacts the workpiece, at a position corresponding to a contact position where the polishing tape contacts the workpiece, arid which crosses over the rotation axis line of the workpiece in a three-dimensional space.

In this apparatus, the contact surface of the press member that contacts the polishing tape can change its inclination relative to the rotation axis line of the workpiece, without changing its position relative to the same. Therefore, in this apparatus, a width of the contact surface (i.e., a dimension of the surface in a direction parallel to the rotation axis line of the workpiece) need not be much longer than that of the target surface (i.e., a dimension of the surface along the rotation axis line of the workpiece). Thus, the size and weight of the press member can be decreased, and the inertia of the same can also be decreased, both of which contribute to improving further the ability of the press member to follow the workpiece.

(5) An apparatus according to the feature (4), wherein the contact surface of the press member is one which straightly extends, like a belt, along the polishing tape, and the rolling axis line coincides with a center line of the contact surface that extends in a direction in which the polishing tape extends.

(6) An apparatus according to any one of the features (1) to (5), further including a pair of tape-support, portions which contact and support the polishing tape, at two positions between which the press member is located, and are moved with the press member.

In this apparatus, since the pair of tape-support portions follow the press member, the polishing tape is bent at a stable angle by the press member, though the press member is moved relative to the holding portion.

(7) An apparatus according to the feature (6), wherein the pair of tape-support portions include a pair of guide rollers each of which is freely rotatable.

(8) An apparatus according to the feature (6), wherein the pair of tape-support portions include a pair of stationary contact portions each of which is fixed in position.

(9) An apparatus according to any one of the features (1) to (8), wherein the contact surface of the press member that contacts the polishing tape is curved toward the workpiece as viewed in a lengthwise direction of a polishing tape.

(10) An apparatus according to any one of the features (1) to (9), wherein the press member is held by the holding portion via a cartridge which is detachably attached to the holding portion, and the rollable-type holding device holds, on the cartridge, the press member such that the press member is rollable relative to the cartridge.

It is desirable that the rollable-type holding device according to the feature (1) be easily maintained. In the polishing apparatus according to this feature, the cartridge including the rollable-type holding device can be easily separated from the holding portion of the apparatus. Thus, the ease of maintenance of the rollable-type holding device is improved.

(11) An apparatus according to any one of the features (1) to (10), further including a movable-type holding device which holds the press member such that the press member is movable relative to the holding portion along a movement axis line which crosses the rotation axis line of the workpiece.

In the case where the rotation axis line of the workpiece does not coincide with the axis line of the target portion, or in the case where the rotation axis line of the workpiece coincides with the axis line of the target portion but the target surface is a non-cylindrical surface such as a cam surface of a camshaft of an engine, a distance between a position where the press member presses the polishing tape against the target surface, and the rotation axis line of the workpiece changes in the direction in which the target surface continues. In the polishing apparatus according to the feature (11), the press member is movable in a direction which crosses the rotation axis line of the workpiece. Therefore, in this apparatus, if the above-indicated distance changes in the direction of continuation of the target surface, the press member is moved relative to the rotation axis line of the workpiece, and relative to a base portion of the apparatus. Thus, the ability of the press member to follow the workpiece can be improved, while at the same time the inertia to resist the movement of the press member can be reduced.

The phrase "the rotation axis line about which the workpiece is rotated", and the phrase of "a rolling axis line which crosses a rotation axis line about which the workpiece is rotated" can be construed to have the same meanings as those described in connection with the feature (1).

(12) An apparatus according to the feature (11), wherein the movable-type holding device includes a rotation preventing mechanism which prevents the press member from rotating about an axis line which crosses the rolling axis line.

(13) An apparatus according to title feature (11) or (12), further including a biasing device which biases the press member toward the workpiece.

In this apparatus, "the biasing device" may be of a type which utilizes an elastic force of an elastic member as a biasing force; of a type which utilizes a pressure as a biasing force; or of a type which utilizes a magnetic force as a biasing force.

(14) An apparatus according to any one of the features (11) to (13), wherein the press member is held by the holding portion via a cartridge which is detachably attached to the holding portion, and the movable-type holding device holds, on the cartridge, the press member such that the press member is movable relative to the cartridge.

It is desirable that like the rollable-type holding device according to the feature (1), the movable-type holding device according to the feature (11) be easily maintained. In the polishing apparatus according to this feature, the cartridge including the movable-type holding device can be easily separated from the holding portion of the apparatus. Thus, the ease of maintenance of the movable-type holding device is improved.

(15) An apparatus according to any one of the features (1) to (14), including a workpiece rotating device which rotates the workpiece about the rotation axis line, and a tape holding device which holds the polishing tape and which includes (a) the holding portion, (b) a cartridge which is detachably attached to the holding portion and which holds the polishing tape at a position opposed to the target surface of the workpiece, and (c) the press member which is held by the cartridge and which presses the back surface of the polishing tape and thereby presses the polishing tape against, the target surface of the workpiece.

(16) A method of polishing a workpiece, by rotating the workpiece while pressing a press member against a back surface of a polishing tape and thereby pressing the polishing tape against a target surface of the workpiece, the method being characterized in that during the polishing of the workpiece the press member is rolled about a rolling axis line which crosses the rotation axis line of the workpiece, so that the press member follows the workpiece.

In this method, the press member can follow the workpiece even in the case where the angle defined by the target surface and the rotation axis line of the workpiece changes in the direction in which the target surface continues.

(17) A method according to the feature (17), wherein the press member is rolled about the rolling axis line relative to a holding portion which holds the press member.

In this method, the inertia to resist the rolling of the press member can be reduced, which leads to improving the ability of the press member to follow the workpiece.

DESCRIPTION OF EMBODIMENTS

Hereinafter, some embodiments of the present invention will be described in detail by reference to the drawings.

Figure 1:
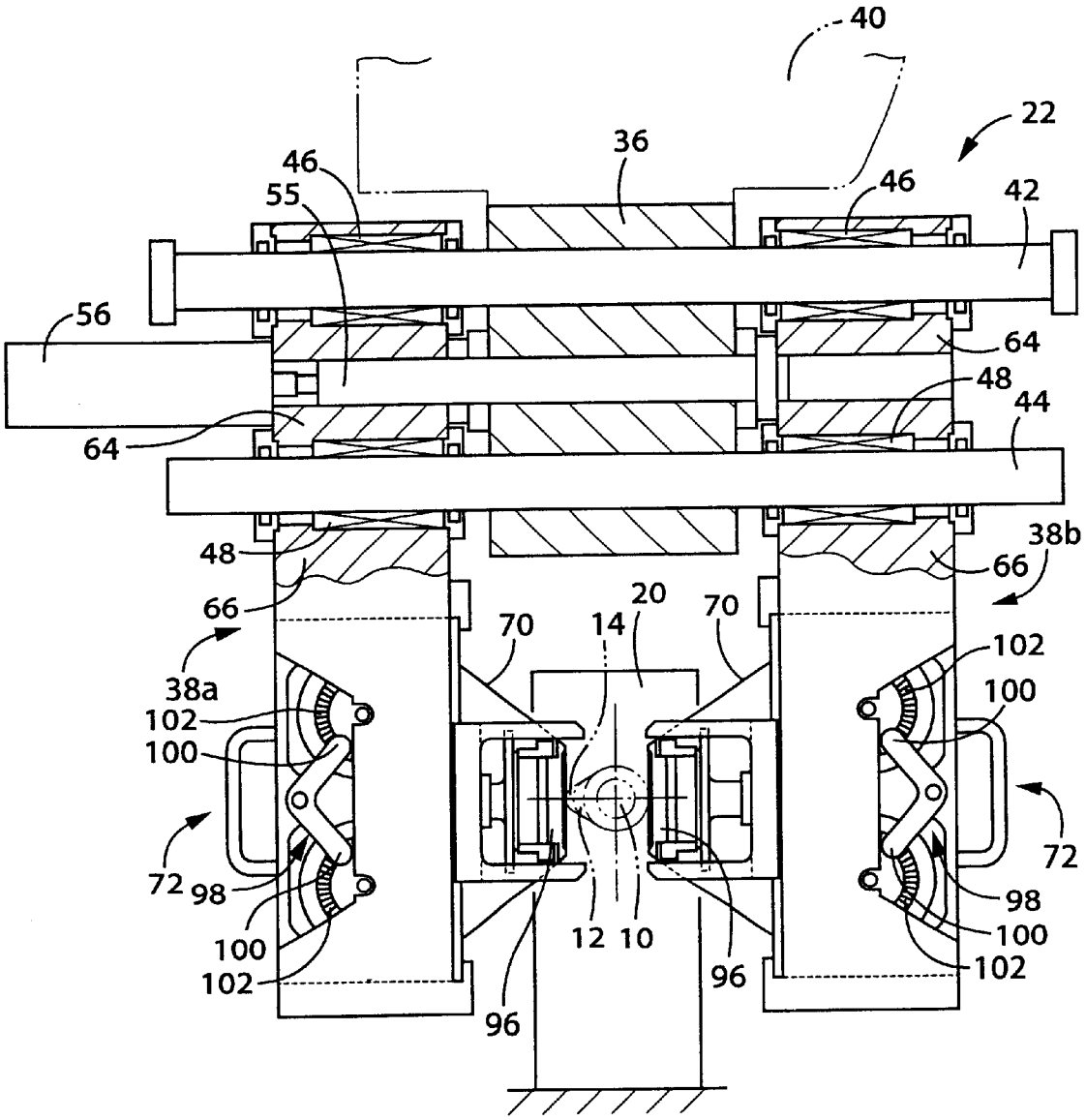
FIG. 1 is a partly cross-sectioned, front elevation view of an entire construction of a polishing apparatus as a first embodiment of the present invention.
Figure 2:
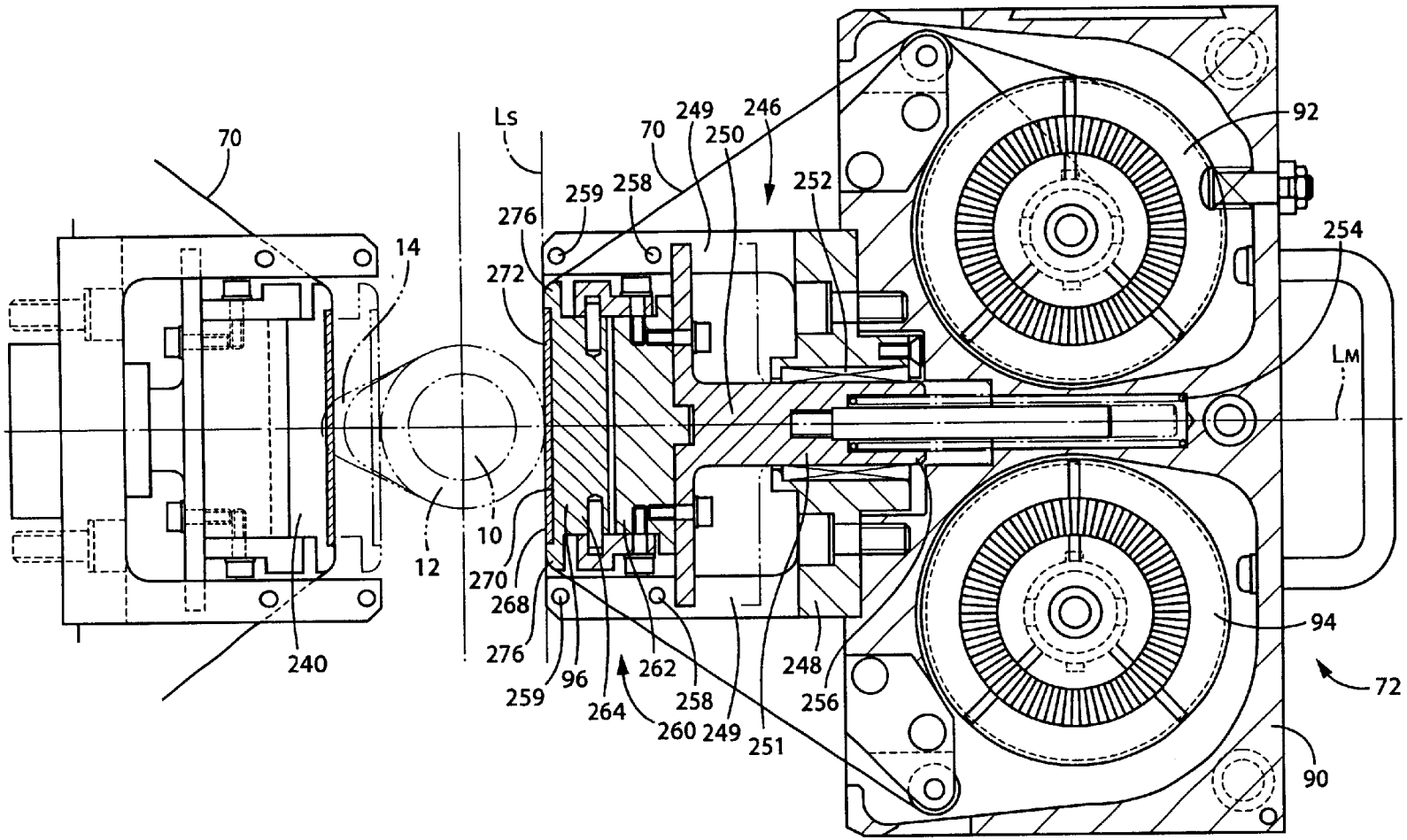
FIG. 2 is a partly cross-sectioned, front elevation view of a cartridge and a shoe of the polishing apparatus of FIG. 1.

FIG. 1 shows a polishing apparatus as a first embodiment of the present invention. This polishing apparatus carries out lapping (as an example of polishing) on a workpiece in the form of a camshaft 10 of an engine of a vehicle, more specifically described, a target surface in the form of each of respective cam surfaces 14 of a plurality of cam portions 12 of the camshaft 10. As shown in FIG. 2, each cam portion 12 is a cubic cam, since the cam surface 14 thereof includes a portion inclined relative to a rotation axis line of the camshaft 10. Lapping-includes wet lapping in which a lapping liquid as a machining liquid is used, and dry lapping in which no lapping liquid is used. This polishing apparatus is designed to carry out the wet lapping.

As shown in FIG. 1, the polishing apparatus includes a workpiece rotating device 20 which includes a motor (not shown) as a drive source and which rotates the camshaft 10 about the rotation axis line thereof.

The polishing apparatus additionally includes a tape holding device 22 which includes a base portion 36 and a pair of clamp arms 38*a,* 38*b*.

The base portion 36 is attached to a frame 40 as a stationary member. A pair of support shafts 42, 44 which horizontally extend parallel to each other are fixed to the base portion 36. The two support shafts 42, 44 are spaced from each other in a vertical direction. Opposite end portions of each of the two support shafts 42, 44 horizontally project from opposite ends of the base portion 36, respectively. The respective left-hand projecting portions of the two support shafts 42, 44 cooperate with each other to support a clamp arm 38*a* via respective linear bearings 46, 48, such that the clamp arm 38*a* is movable in an axial direction of the shafts 42, 44, and the respective right-hand projecting portions of the two support shafts 42, 44 cooperate with each other to support a clamp arm 38*b* via respective linear bearings 46, 48, such that the clamp arm 38*b* is movable in the axial direction of the shafts 42, 44. A rod 55 is fitted in the base portion 36, at a position between the two support shafts 42, 44, such that the rod 55 extends parallel to the shafts 42, 44 and is slideable in an axial direction of the rod 55. Opposite end portions of the rod 55 horizontally project from the opposite ends of the base portion 36, respectively. The left-hand projecting portion of the rod 55 is connected to a piston of a clamp cylinder 56 whose housing is fixed to the one clamp arm 38*a,* and the right-hand projecting portion of the rod 55 is connected to the other clamp arm 38*b*.

Therefore, in this tape holding device 22, when the clamp cylinder 56 retracts the rod 55, the two clamp arms 38*a,* 38*b* are moved toward each other and, when the clamp cylinder 56 extends the rod 55, the two clamp arms 38*a,* 38*b* are moved away from each other. Before the camshaft 10 to be polished is set on the workpiece rotating device 20, the two clamp arms 38*a,* 38*b* are moved away from each other. In this state, the camshaft 10 is set, and then the two clamp arms 38*a,* 38*b* are moved toward each other. During the polishing, the distance between the two clamp arms 38*a,* 38*b* is maintained.

Each of the clamp arms 38*a,* 38*b* includes a base portion 64 and a holding portion 66. The base portion 64 is slideably fitted on the two support shafts 42, 44, and the holding portion 66 holds a cartridge 72 such that the cartridge 72 is detachable from the holding portion 66. The cartridge 72 holds a polishing tape 70 which extends like a belt. The polishing tape 70 includes a base sheet (film) formed of a synthetic resin, and polishing particles held on the base sheet. The two clamp arms 38*a,* 38*b* hold the two cartridges 72, 72, respectively, at respective positions opposed to each other via the cam portion 12.

As shown in FIG. 2, each cartridge 72 includes a polishing tape 70; a housing 90; a tape-up reel 92 and a supply reel 94 which are provided on a common plane and on which the polishing tape 70 is wound; and a shoe 96 as a press member.

As shown in FIG. 1, the cartridge 72 additionally includes a V-shaped removal preventing member 98 which prevents the reels 92, 94 from removing from the housing 90. The housing 90 has six outer walls, and opens in one of the two outer walls each of which intersects respective rotation axis lines of the reels 92, 94. The reels 92, 94 are attached to, and detached from, the cartridge 72, through the opening wall of the housing 90. The removal preventing member 98 is provided for preventing the reels 92, 94 attached to the cartridge 72, from removing from the same 72 through the opening wall. The removal preventing member 98 can be selectively positioned at one of an inhibiting position where the member 98 inhibits the reels 92, 94 from passing through the opening wall, and an allowing position where the member 98 allows the reels 92, 94 to pass. When the reels 92, 94 are exchanged, the removal preventing member 98 is positioned at the allowing position by an operator; and when the polishing is carried out, the member 98 is positioned at the inhibiting position (shown in the figure) by the operator.

The removal preventing member 98 includes two contact portions 100 which elastically contact the two reels 92, 94, respectively. Each of the two reels 92, 94 includes an uneven annular portion 102 which is contacted by the corresponding contact portion 100 of the removal preventing member 98. The contact portion 100 and the annular portion 102 cooperate with each other to provide a detent mechanism which holds, owing to the engagement of the contact portion 100 with the annular portion 102, the reel 92, 94 at an arbitrary position. Thus, each reel 92, 94 is prevented from freely rotating.

In this polishing apparatus, each time the polishing of one cam portion 12 is finished, a predetermined length of the polishing tape 70 is fed in a lengthwise direction thereof, so that each cam portion 12 can be polished with a new portion of the tape 70. To this end, this polishing apparatus includes a tape take-up device 104.

Figure 3:
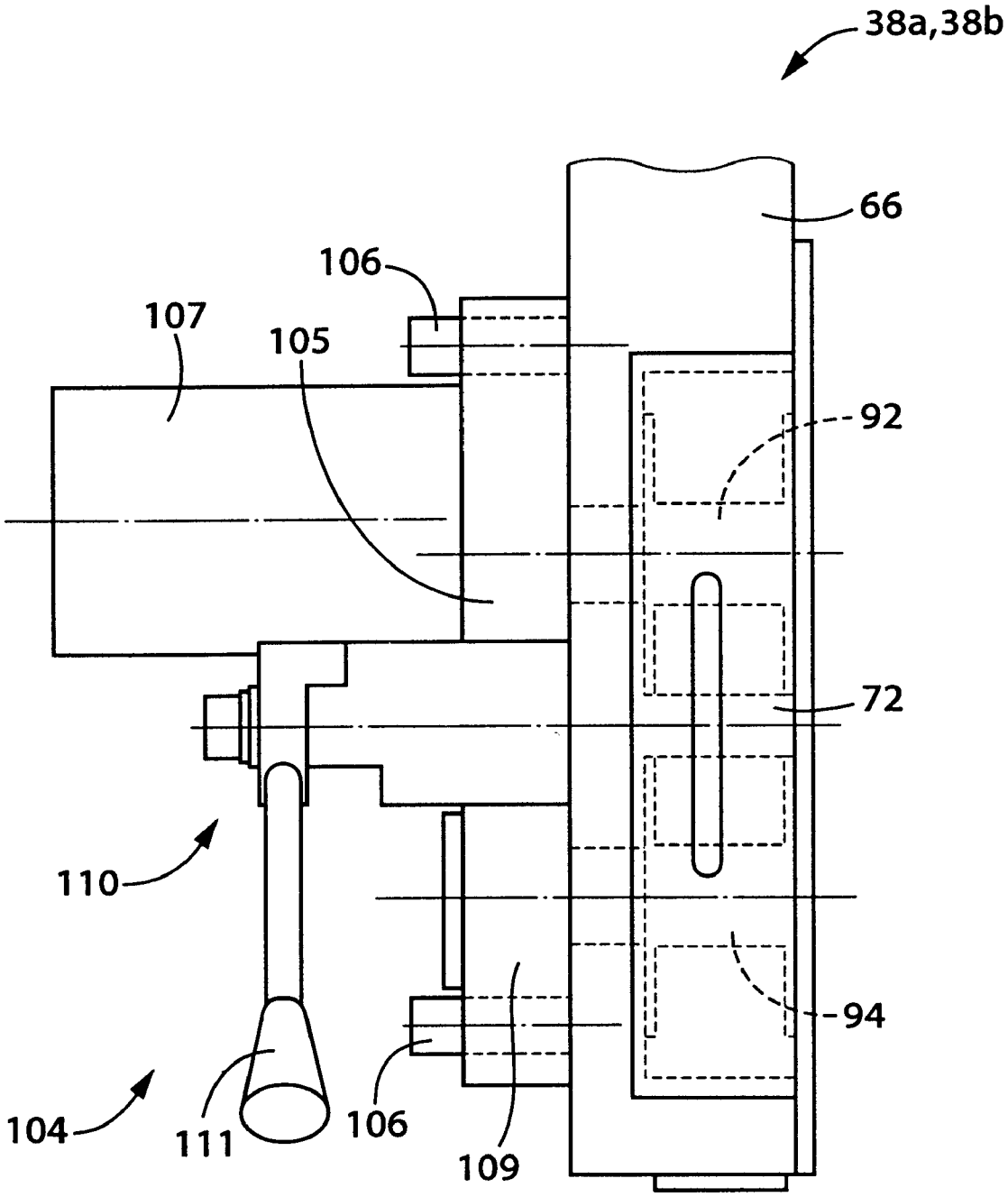
FIG. 3 is a side elevation view of a holding portion of a clamp arm and a tape take-tip device of the polishing apparatus.

FIG. 3 shows the tape take-up device 104, which includes a housing 105. The housing 105 is attached to the holding portion 66 of each clamp arm 38*a*, 38*b*. The housing 105 is positioned relative to the holding portion 66, with a plurality of positioning pins 106. A motor 107 is attached to the housing 105. The motor 107 is connected to a shaft of the take-up reel 92, by a connecting mechanism incorporated in the housing 105, such that the motor 107 is rotatable as a unit with the reel 92 and is separable from the same 92. A rotation-resistance applying mechanism 109 which applies resistance to the rotation of the reel 92 is also attached to the housing 105. The rotation-resistance applying mechanism 109 is connected to the supply reel 94, such that the mechanism 109 is coaxial with the reel 94 and is separable from the same 94. The tape take-up device 104 additionally includes a lock device 110 which includes an operation lever 111 and which is mechanically switched, with the operation lever 111, between a locking state in which the lock device 110 locks the cartridge 72 in the clamp arm 38*a*, 38*b* and a releasing state in which the lock device 110 releases the same 72 from the locking.

Before the polishing of one camshaft 10 is started, the tape take-up device 104 is attached, and fixed, to the clamp arm 38*a*, 38*b*. A plurality of cam portions 12 of the one camshaft 10 are polished such that each time the polishing of one cam portion 12 is finished, the motor 107 is rotated by a controller (not shown) to feed a predetermined amount of the polishing tape 70 under monitoring of a sensor (not shown). When all the polishing tape 70 wound on the supply reel 94 has been consumed, the lock device 110 is placed in its releasing state, and the cartridge 72 is removed from the clamp arm 38*a*, 38*b*. In addition, the removal preventing member 98 is positioned at its allowing position, and the two reels 92, 94 are removed from the cartridge 72 and are exchanged with new ones.

Figure 4:
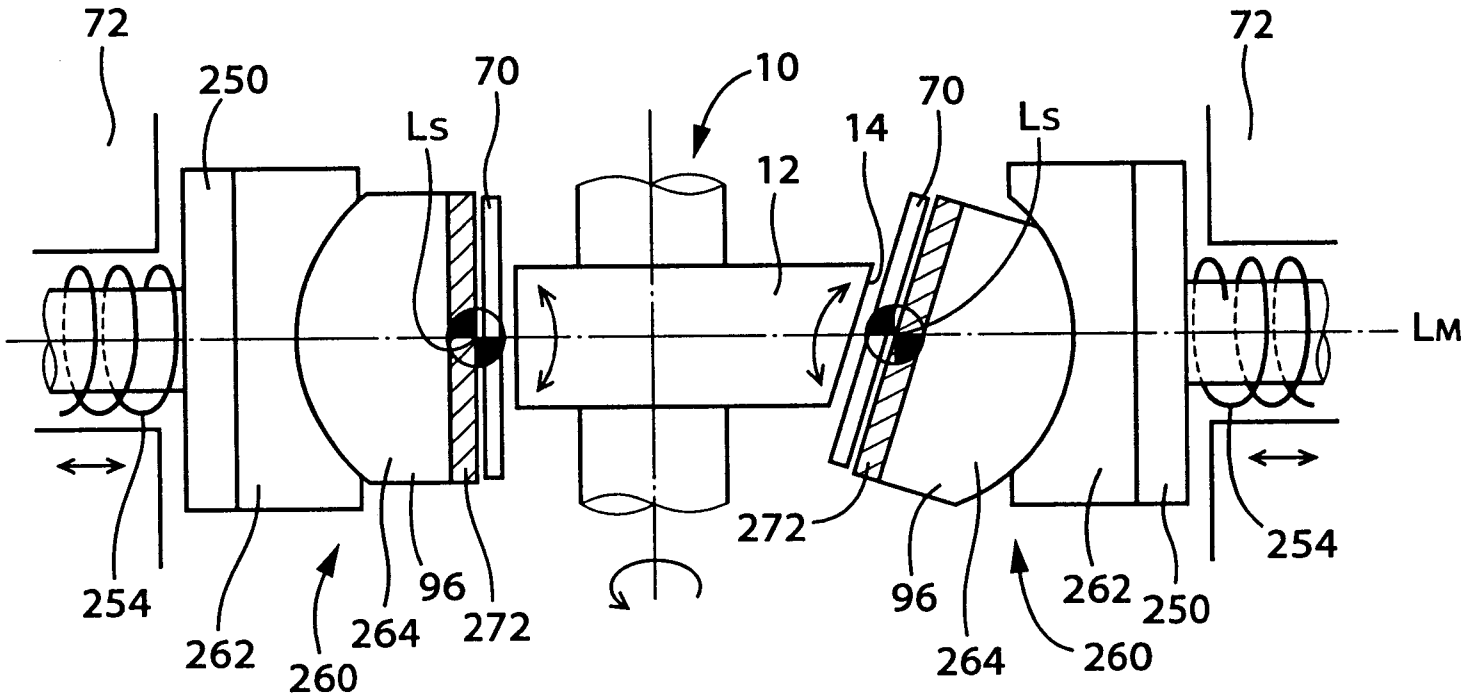
FIG. 4 is a plan view for schematically showing essential portions of the first embodiment.
Figure 5:
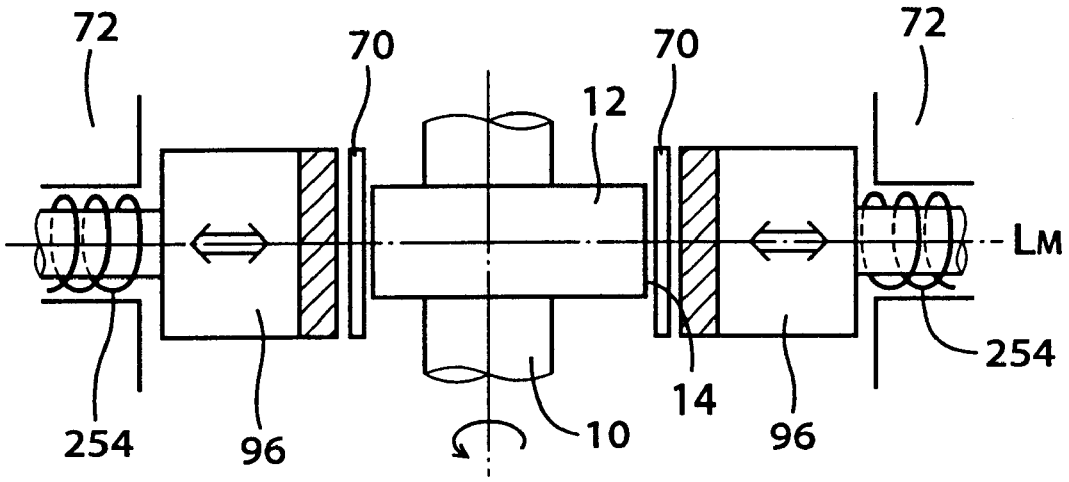
FIG. 5 is a plan view for showing essential portions of an example to be compared with the first embodiment.

FIG. 4 schematically shows essential portions of this polishing apparatus, and FIG. 5 schematically shows essential portions of a polishing apparatus as an example to be compared.

Figure 6:
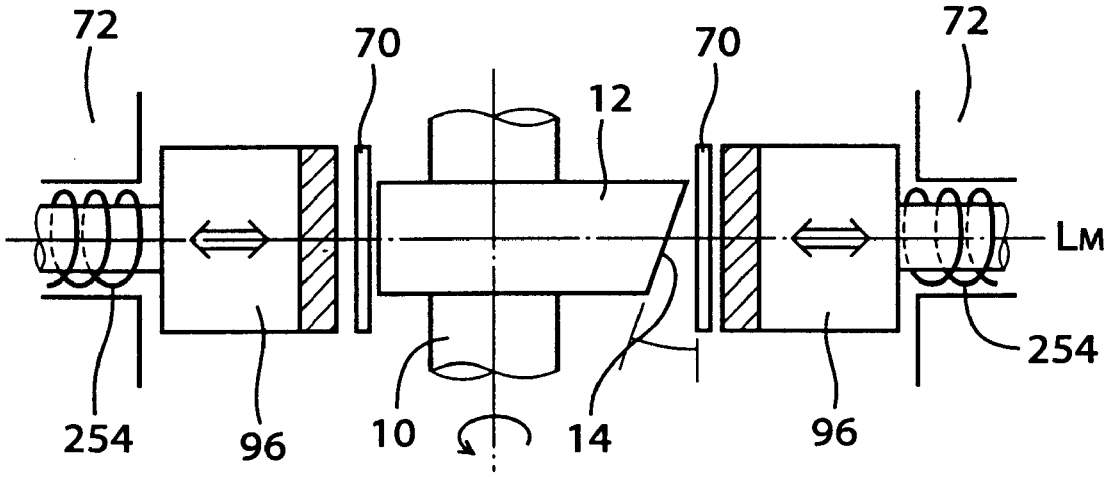
FIG. 6 is a plan view for explaining problems with the comparative example of FIG. 5.

In the comparative example shown in FIG. 5, a shoe 96 is attached to a cartridge 72 such that the shoe 96 is only movable relative to the cartridge 72. In the case where a cam surface 14 does not include any portions inclined relative to a rotation axis line of a camshaft 10 and accordingly an angle defined by the cam surface 14 and the rotation axis line of the camshaft 10 does not change in a direction in which the cam surface 14 continues, the comparative example can polish all of the cam surface 14. However, in the case, shown in FIG. 6, where a cam surface 14 includes a portion inclined relative to a rotation axis line of a camshaft 10 and accordingly an angle defined by the cam surface 14 and the rotation axis line of the camshaft 10 changes in a direction in which the cam surface 14 continues, the comparative example cannot polish all of the cam surface 14. In contrast thereto, in the present embodiment, shown in FIG. 4, the shoe 96 is attached to the cartridge 72, such that the shoe 96 is movable relative to the cartridge 72 along a movement axis line $L_M$, and is rollable relative to the cartridge 72 about a rolling axis line $L_S$ which is perpendicular to both the movement axis line $L_M$ and the axial direction of the camshaft 10.

As shown in FIG. 2, a projecting member 246 is attached to a portion of the housing 90 of the cartridge 72 that is opposed to the cam portion 12, such that the projecting member 246 is fixed in position. This projecting member 246 has a shape which includes a base portion 248 and a pair of side plates 249, 249 which extend from the base portion 248 toward the cam portion 12 while taking such a posture that the side plates 249 perpendicularly cross the rotation axis line of the camshaft 10. The two side plates 249, 249 are spaced from, and opposed to, each other. Each side plate 249 has a generally U-shaped configuration opening toward the cam portion 12. A movable member 250 is provided between the two side plates 249, 249, with respective clearances being left between the movable member 250 and the two plates 249, 249, and a guide 251 extends from the movable member 250 in a direction away from the cam portion 12. The guide 251 is supported by the projecting member 246 via a linear bearing 252, such that the guide 251 is movable in an axial direction thereof. An axis line of the guide 251 coincides with the movement axis line $L_M$ of the shoe 96.

A coil spring 254 as an elastic member is provided between the movable member 250 and the housing 90, and biases the movable member 250 in a direction toward the cam portion 12. The limit of movement of the movable member 250 toward the housing 90 is defined by butting of a stopper 256 integrally formed with the guide 251 against the housing 90, and the limit of movement of the movable member 250 away from the housing 90 is defined by a pair of spring pins 258 (stopper members) opposite ends of each of which are supported by the two side plates 249, 249. In addition, the rotation of the movable member 250 is inhibited by butting of the movable member 250 against the two side plates 249, 249. Another pair of spring pins 259 are attached to the two side plates 249, 249, at respective positions which are nearer to the cam portion 12 than the above-indicated pair of spring pins 258. The polishing tape 70 passes between each of the spring pins 258 and a corresponding one of the spring pins 259 that is opposed to the each spring pin 258. That is, the spring pins 258 and the spring pins 259 cooperate with each other to function as tape guides for guiding the polishing tape 70.

A rollable-type holding device 260 is attached to an end of the movable member 250. The rollable-type holding device 260 includes a support portion 262 which is supported by the movable member 250 such that the support portion 262 is fixed in position, and a head 264 with which the shoe 96 is integrally formed and which is connected to the support portion 262 such that the head 264 is rollable about the rolling axis line $L_S$.

A portion of the head 264 that is opposed to the cam portion 12 functions as the shoe 96, and a surface of the shoe 96 that is opposed to the cam portion 12 provides a contact surface 268 of the shoe 96 that contacts the polishing tape 70. This contact surface 268 has a belt-like shape, and is defined by a plane which extends along the rolling axis line $L_S$. The contact surface 268 has, in an intermediate portion thereof in a lengthwise direction thereof, a recess 270 to which a thin-plate-like elastic member 272 is adhered. The shoe 96 as a rigid member contacts a back surface of the polishing tape 70 via the elastic member 272, and presses the polishing tape 70 against the cam surface 14 of the cam portion 12. In addition, lengthwise opposite end portions of the head 264 function as a pair of stationary support portions 276 which cooperate with each other to guide the polishing tape 70. The two support portions 276 are moved and rolled integrally with the shoe 96. In a left-side portion of FIG. 2, the shoe 96 is positioned at two positions respectively indicated at solid line and two-dot chain line. The position indicated at solid line is the most retracted position of the shoe 96 in the projecting member 246, and the position indicated at two-dot chain line is the most advanced position of the shoe 96 from the projecting member 246.

Figure 7:
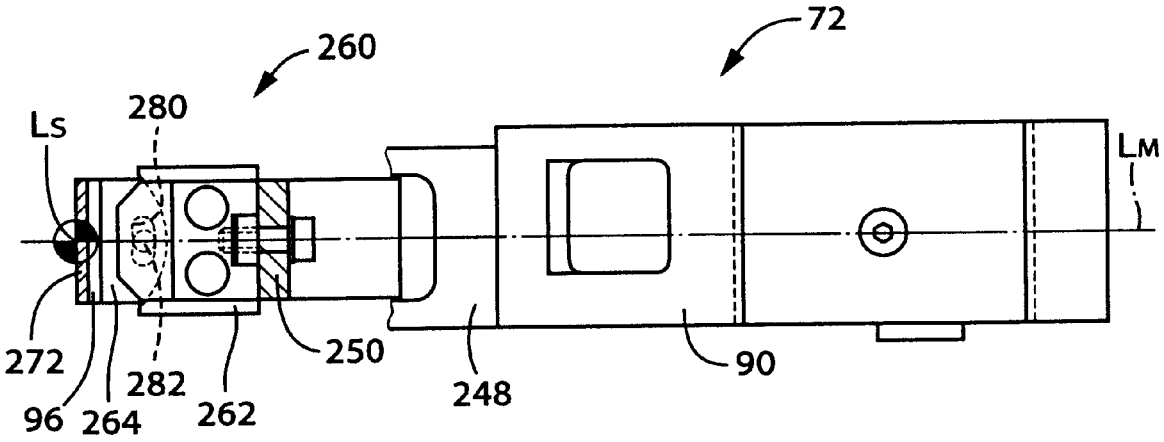
FIG. 7 is a plan view of a rollable-type holding device of the polishing apparatus.
Figure 8:
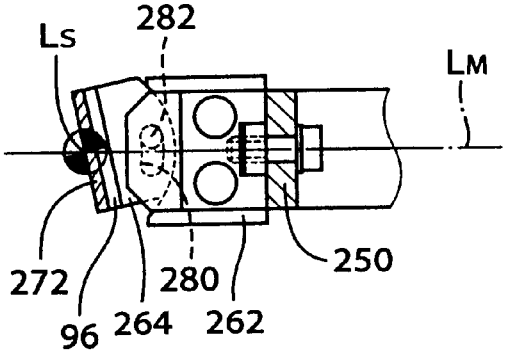
FIG. 8 is a plan view for showing a state in which the rollable-type holding device is operating.

FIG. 7 shows a plan view of the rollable-type holding device 260. As shown in this figure, the rolling axis line $L_S$ coincides with a center line of the contact surface 268 that extends in the same direction as the direction in which the polishing tape 70 extends. The support portion 262 has a concave part-cylindrical surface whose center is located on the rolling axis line $L_S$, and the head 264 has a convex part-cylindrical surface which fits in the concave part-cylindrical surface of the support portion 262. The head 264 has two elongate holes 280 each of which extends along an arc whose center is located on the rolling axis line $L_S$, and the support portion 262 supports two pins 282 such that the pins 282 are fixed in position and slideably fit in the two elongate holes 280, respectively. The two elongate holes 280 are formed in vertically opposite end portions of the support portion 262, respectively, and the two pins 282 are supported by vertically opposite end portions of the head portion 264, respectively. Owing to this construction, the shoe 96 is supported by the support portion 262 such that the shoe 96 is rollable about the rolling axis line $L_S$. FIG. 8 shows a state in which the shoe 96 is rolled relative to the support portion 262 by the greatest angle about the rolling axis line $L_S$. The angular range of rolling of the shoe 96 relative to the support portion 262 is defined by butting of the pins 282 against opposite ends of the elongate holes 280.

In the present embodiment, the rolling axis line $L_S$ is located at a position about which, during the polishing of the cam portion 12, a moment which rolls the shoe 96 to follow the cam portion 12 is produced by a force which is exerted by the camshaft 10 to the shoe 96. Therefore, in the present embodiment, during the polishing of the cam portion 12, the shoe 96 is rolled by the cam portion 12, so that the shoe 96 follows the cam portion 12.

As is apparent from the foregoing description, in the present embodiment, the angle of inclination of the contact surface 268 of the shoe 96 relative to the rotation axis line of the camshaft 10 changes while the position of the surface 268 relative to the axis line does not change. Therefore, the width of the contact surface 268 need not be much longer than that of the cam surface 14, and accordingly the shoe 96 can be reduced in size and weight and in inertia. Thus, the ability of the shoe 96 to follow the camshaft 10 is improved.

In addition, in the present embodiment, when the shoe 96 is rolled to follow the cam surface 14, substantially no friction force is produced between the shoe 96 and the cam surface 14, in a direction to resist the rolling of the shoe 96. Thus, the shoe 96 is smoothly rolled, which also improves the ability of the shoe 96 to follow the cam surface 14.

It emerges from the foregoing description that in the present embodiment, the movable member 250 and the guide 251 cooperate with each other to provide a movable-type holding device.

Figure 9:
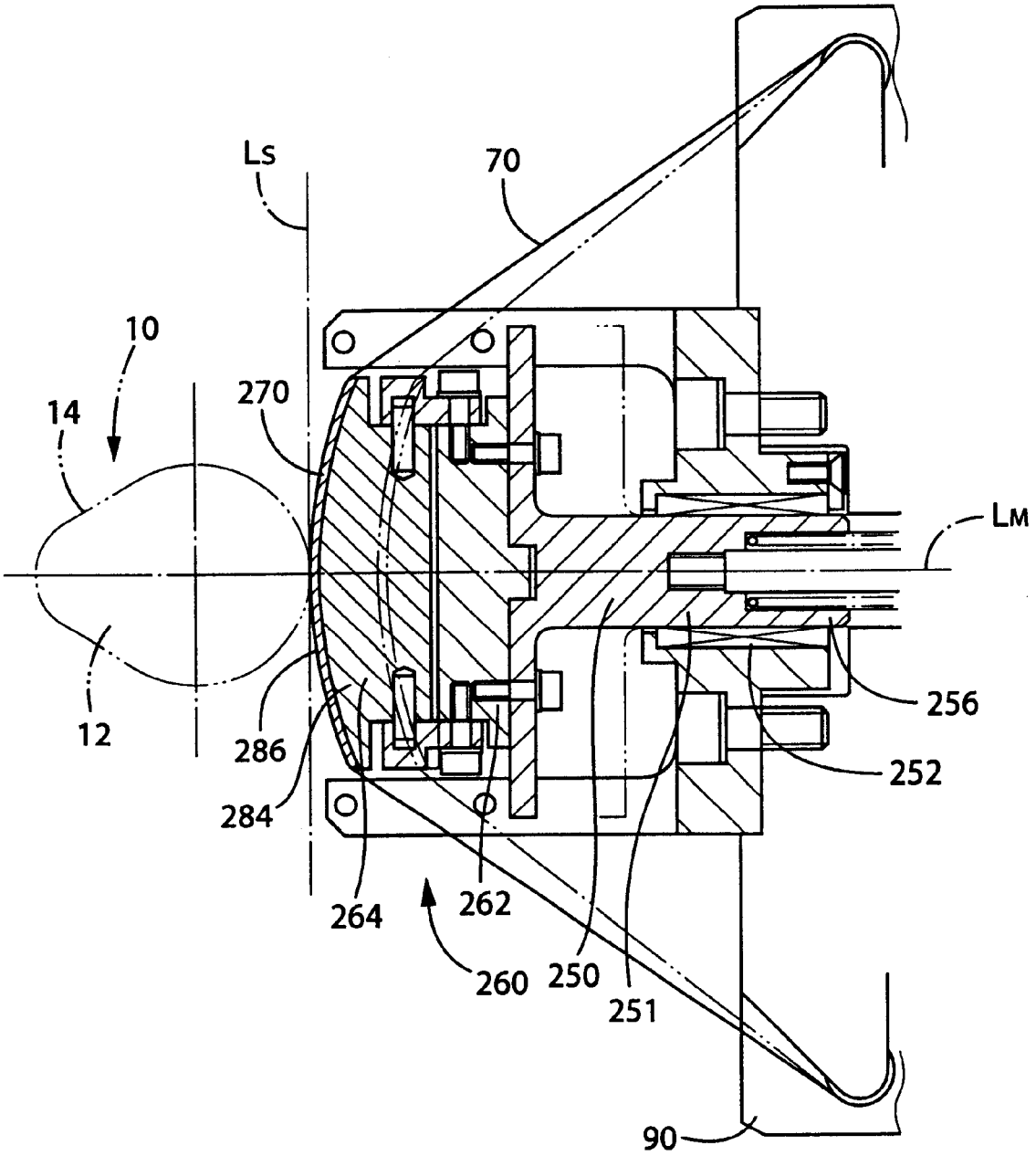
FIG. 9 is a front view of a modified form of the shoe of the first embodiment.

In this connection, it is noted that though in the present embodiment the contact surface 268 of the shoe 96 is defined by a plane, it is possible, as shown in FIG. 9, that a contact surface 286 of a shoe 284 be defined by a curved surface which is curved convexly toward a cam portion 12 as seen in a widthwise direction of a polishing tape 70. In this case, a rolling axis line $L_S$ about which the shoe 96 is rolled contacts the contact surface 286 at a position corresponding to a contact position where the polishing tape 70 contacts a camshaft 10, and the rolling axis line $L_S$ coincides with a straight line which perpendicularly crosses over a rotation axis line of the camshaft 10 in a three-dimensional space.

Next, there will be described another polishing apparatus as a second embodiment of the present invention. However, many elements employed in the second embodiment are common to the first embodiment, and the second embodiment is different from the first embodiment with respect to only elements which are related to the technique of rolling a shoe. Accordingly, only those different elements will be described in detail below, while the same reference numerals as used in the first embodiment are used to designate the corresponding elements of the second embodiment and the detailed description of those elements is omitted.

Figure 10:
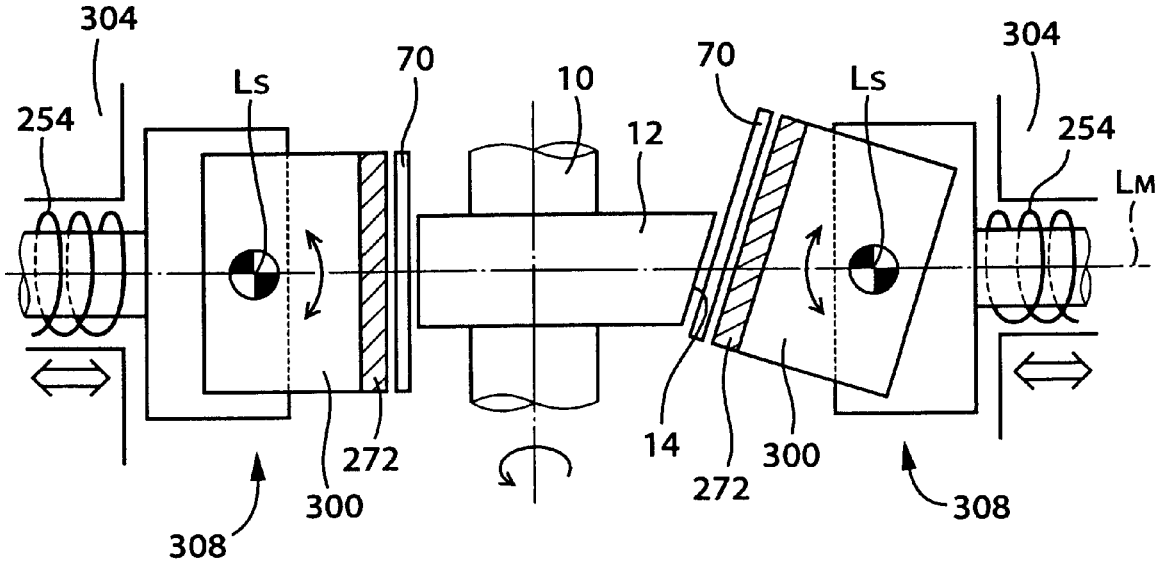
FIG. 10 is a plan view for schematically showing essential portions of another polishing apparatus as a second embodiment of the present invention.

In the first embodiment, the rolling axis line $L_S$ of the shoe 96 coincides with the center line of the contact surface 268 of the shoe 96. in contrast, in the second embodiment, as shown in FIG. 10, a rolling axis line $L_S$ about which a shoe 300 is rolled coincides with a straight line which perpendicularly crosses a movement axis line $L_M$ of the shoe 300, at a position which is nearer to a cartridge 304 to which the shoe 300 belongs, than to a center line of a contact surface of the shoe 300. The cartridge 304 has a construction similar to that of the cartridge 72 of the first embodiment, the technique to attach the shoe 300 to the cartridge 304 such that the shoe 300 is movable along the movement axis line $L_M$ is similar to that employed in the first embodiment, and a rollable-type holding device 308 which holds the shoe 300 such that the shoe 300 is rollable about the rolling axis line $L_S$ has a simple construction in which pins coaxial with the rolling axis line $L_S$ connect the shoe 300 to the cartridge 304 such that the shoe 300 is rollable about the rolling axis line $L_S$. Accordingly, further detailed description of the second embodiment is omitted.

Next, there will be described another polishing apparatus as a third embodiment of the present invention. However, many elements employed in the third embodiment are common to the first embodiment, and the third embodiment is different from the first embodiment with respect to only the shape of a shoe. Accordingly, only the shoe will be described in detail below, while the same reference numerals as used in the first embodiment are used to designate the corresponding elements of the third embodiment and the detailed description of those elements is omitted.

Figure 11:
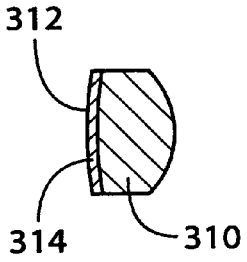
FIG. 11 is a cross-sectioned, plan view of a shoe of another polishing apparatus as a third embodiment of the present invention.

In the first embodiment, as shown in FIG. 2, the contact surface 268 of the shoe 96 is defined by a plane. In contrast, in the third embodiment, as shown in FIG. 11, a contact surface 312 of a shoe 310 is curved convexly toward a cam portion 12 as seen in a lengthwise direction of a polishing tape 70. Like in the first embodiment, the shoe 310 contacts the polishing tape 70 via an elastic member 314.

Next, there will be described another polishing apparatus as a fourth embodiment of the present invention. However, many elements of the fourth embodiment are common to the first embodiment, and the fourth embodiment is different from the first embodiment with respect to only elements which are related to the technique of applying a pressing force to a shoe. Accordingly, only those different elements will be described in detail below, while the same reference numerals as used in the first embodiment are used to designate the corresponding elements of the fourth embodiment and the detailed description of those elements is omitted.

In the first embodiment, the spring 254 applies, to the shoe 96, a force with which the shoe 96 presses the polishing tape 70 against the cam surface 14. The spring 254 is designed such that the elastic force of the spring 254 changes as least as possible as the spring 254 is compressed. However, it is impossible to zero completely the change of elastic force of the spring 254. Therefore, in the case where, as a camshaft 10 is rotated, the distance between a portion of the cam surface 14 against which the polishing tape 70 is pressed by the shoe 96, and a rotation axis line of the camshaft 10 changes and accordingly the length of compression of the spring 254 changes, the force with which the polishing tape 70 is pressed against the cam surface 14 also changes.

Figure 12:
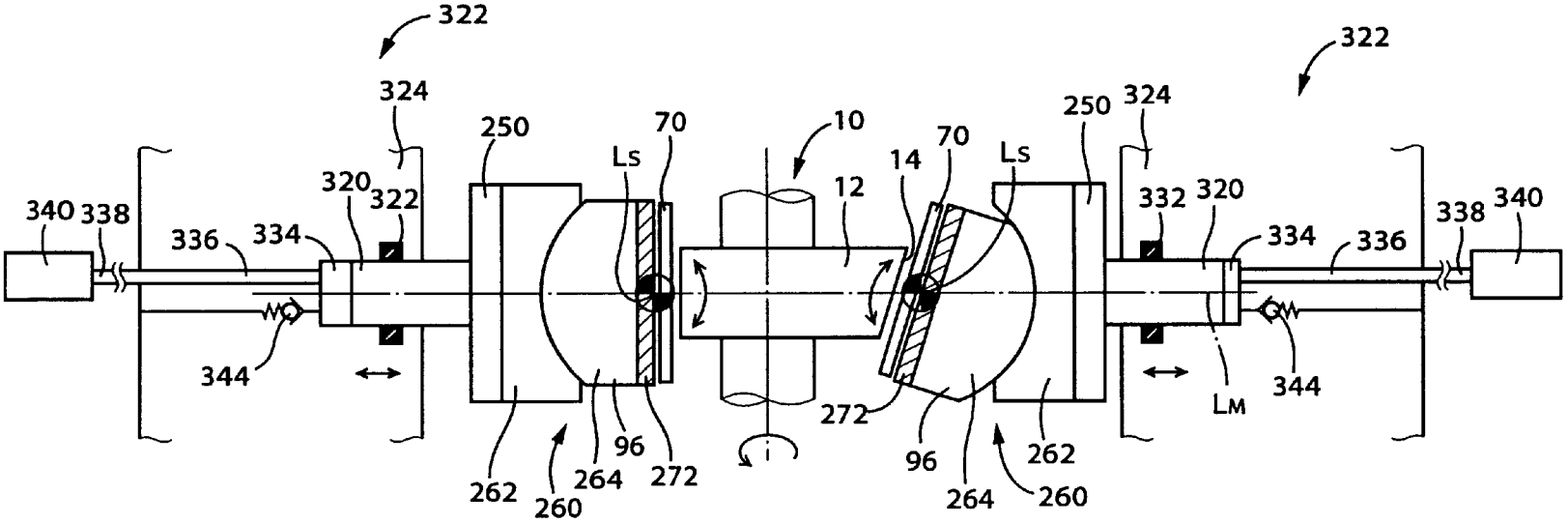
FIG. 12 is a plan view for schematically showing essential portions of another polishing apparatus as a fourth embodiment of the present invention.

In contrast, in the fourth embodiment, as shown in FIG. 12, a piston 320 extends from the movable member 250 along the movable axis line LM in a direction away from a cam portion 12, and the piston 320 substantially fluid-tightly fits in a housing 324 of a cartridge 322 such that the piston 320 is slideable relative to the housing 322. The cartridge 322 and the housing 324 have respective constructions which are basically common to those of the cartridge 72 and the housing 90 of the first embodiment. In the figure, reference numeral 332 denotes an air seal. In a state in which the piston 322 is fitted in the housing 324, an air chamber 334 is formed in the housing 324. The air chamber 334 is connected to an air-pressure source 340 via a passage 336 and an external flexible hose 338. The air-pressure source 340 supplies the air chamber 334 with a substantially constant pressure. A relief valve 344 is provided between the air chamber 334 and the atmosphere. The relief valve 344 is designed such that the valve 344 is opened at a relief pressure lower than the pressure supplied by the air-pressure source 340. In addition, the relief valve 344 is also designed such that when the pressure in the air chamber 334 is equal to the relief pressure, the shoe 96 presses the polishing tape 70 against the cam surface 14, with an appropriate pressing force.

In the polishing apparatus constructed as described above, a force with which the shoe 96 presses the polishing tape 70 against the cam surface 14 is produced by the pressure in the air chamber 334. When the shoe 96 is advanced and retracted, the volume of the air chamber 334 is increased and decreased. When the volume of the air chamber 334 is increased and the pressure is decreased, the relief valve 344 is closed to prevent the decreasing of the pressure; and when the volume of the air chamber 334 is decreased and the pressure is increased, the relief valve 344 is opened to prevent the increasing of the pressure. Thus, irrespective of whether the shoe 96 is advanced or retracted, the pressure in the air chamber 334 is maintained at substantially a constant value, and accordingly the force which which the shoe 96 presses the polishing tape 70 against the cam portion 12 is maintained at substantially a constant value.

In each of the above-described polishing apparatuses, the press member can follow the target surface of the workpiece, not only in the case where the target surface includes no portion which is inclined relative to the rotation axis line of the workpiece, but also in the case where the target surface includes a portion which is inclined relative to the rotation axis line of the workpiece. In particular, in the case where the target surface includes no portion which is inclined relative to the rotation axis line of the workpiece, it may be needed to allow the press member to move relative to the cartridge but inhibit the press member from rolling relative to the cartridge. For example, in the case where a cam portion 12 as a target portion of a workpiece is a so-called plane cam whose entire cam surface 14 as a target surface is parallel to a rotation axis line of a camshaft 10, it is desirable to smoothen the cam surface 14 without lowering the degree of straightness and/or parallelism thereof before the polishing thereof. To this end, it may be needed to prevent the press member from rolling relative to the cartridge. In view of this, each of the above-described polishing apparatuses is adapted to allow the cartridge to be replaced with another cartridge of a type which allows only the movement of the press member.

Figure 13:
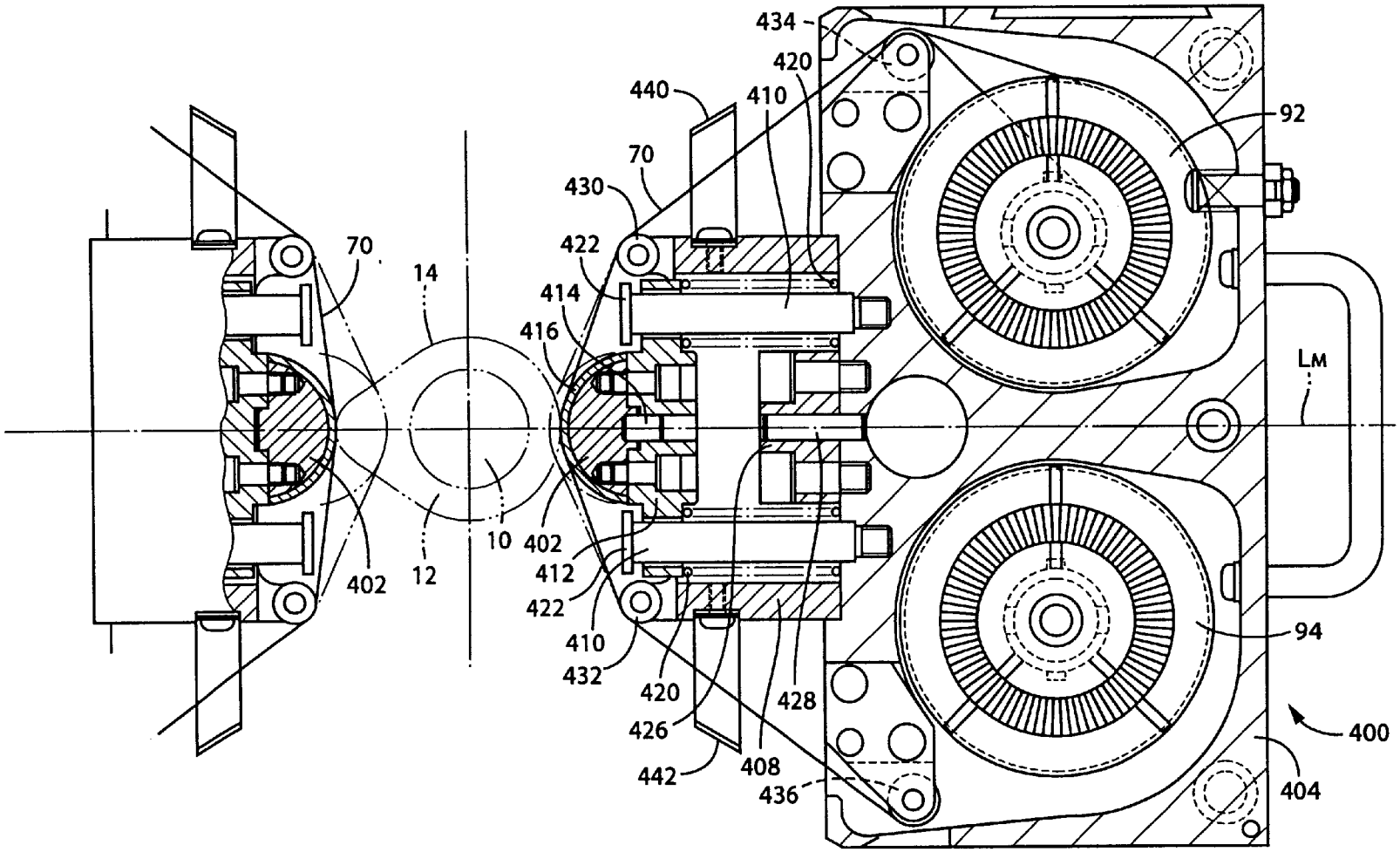
FIG. 13 is a partly cross-sectioned, front elevation view of another cartridge different from the cartridge shown in FIG. 2.
Figure 14:
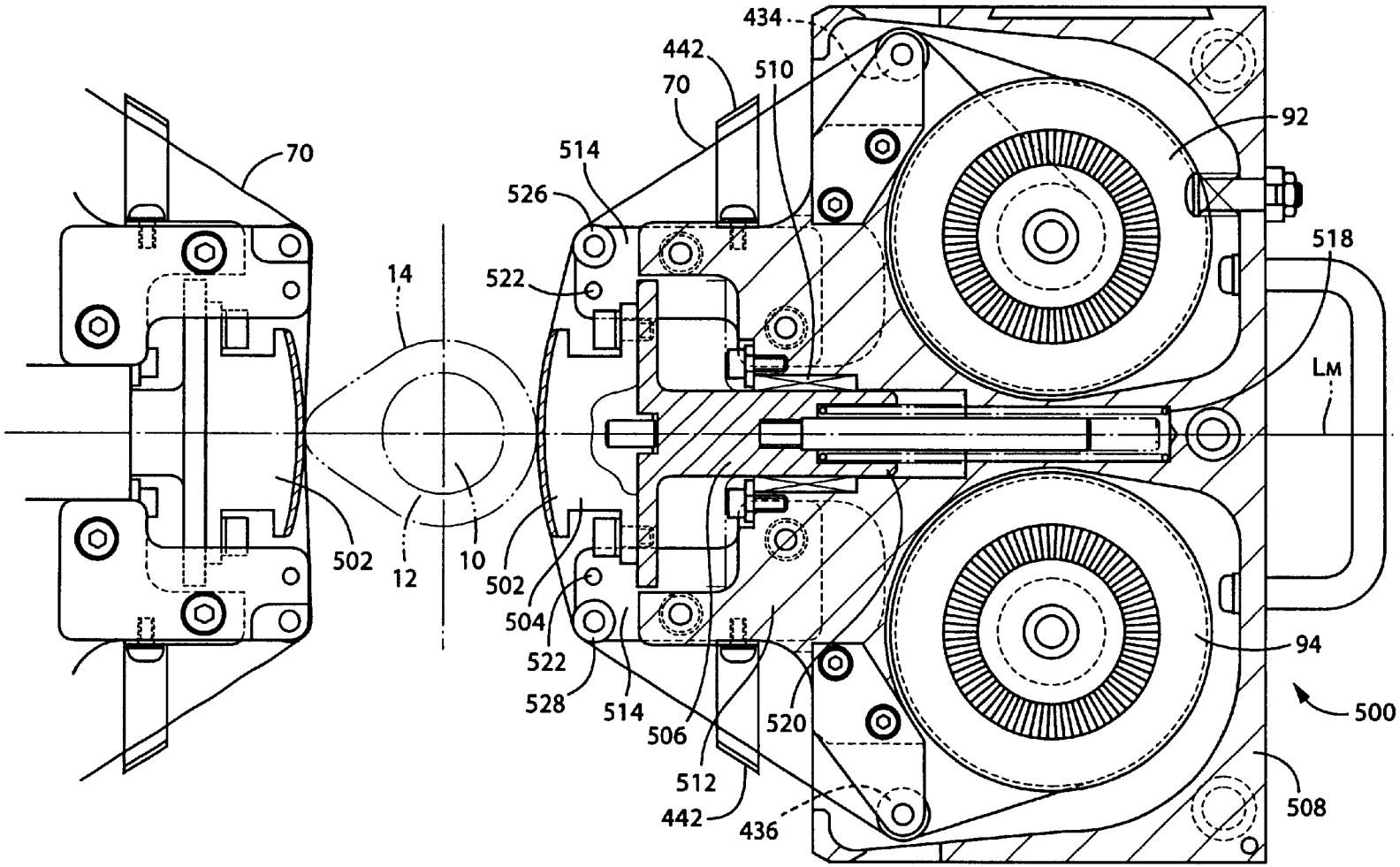
FIG. 14 is a partly cross-sectioned, front elevation view of yet another cartridge different from the cartridge shown in FIG. 2.

FIGS. 13 and 14 show respective cartridges of the above-indicated type. Hereinafter, the cartridges of the above-indicated type will be described by reference to those figures. However, since many elements of those cartridges are common to the cartridge 72 shown in FIG. 2, the same reference numerals as used for the cartridge 72 are used to designate the corresponding elements of each of the cartridges shown in FIGS. 13 and 14, and the detailed description of those elements is omitted. Only different elements will be described in detail.

In a cartridge 400 shown in FIG. 13, a shoe 402 as a press member is attached to a housing 404 such that the shoe 402 is movable along the movement axis line $L_M$.

A projecting member 408 is attached to a portion of the housing 404 that is opposed to a cam portion 12, such that the projecting member 408 is fixed in position and projects toward the cam portion 12. Two guide pins 410 are attached to the housing 404 such that the guide pins 410 extend through the projecting member 408, parallel to the movement axis line $L_M$. The two guide pins 410 are provided on both sides of the movement axis line $L_M$ as seen in a lengthwise direction of a polishing tape 70. A movable member 412 fits on the two guide pins 410, such that the movable member 412 is movable in an axial direction of the pins 410. Thus, the movable member 412 is movable relative to the housing 404 along the movement axis line $L_M$. Since the guide pins 410 are plural, the movable member 412 is prevented from rotating about the movement axis line $L_M$. That is, the two guide pins 410 have not only the function of guiding the movement of the movable member 412 but also the function of preventing the rotation of the same 412. The projecting member 408 has an inner space which allows the movable member 412 to move toward the housing 404.

The shoe 402 is attached to a portion of the movable member 412 that is opposed to the cam portion 12. A positioning pin 414 positions the shoe 402 on the movement axis line $L_M$. The shoe 402 has a semi-cylindrical cross section and extends in a direction parallel to a rotation axis line of a camshaft 10. Therefore, the shoe 402 has a contact surface which is curved convexly toward the cam portion 12 as seen in a widthwise direction of the polishing tape 70, and the curved contact surface is pressed on a back surface of the polishing tape 70. A thin-plate-like elastic member 416 is adhered to a surface of the shoe 402, and the shoe 402 contacts the back surface of the polishing tape 70 via the elastic member 416.

Two coil springs 420 each as an elastic member are provided between the movable member 412 and the housing 404. Each of the two guide pins 410 extends through a corresponding one of the two coil springs 420. The two springs 420 cooperate with each other to bias the movable member 412 in a direction toward the cam portion 12. The two guide pins 410 include respective large-diameter portions 422 which cooperate with each other to prevent the movable member 412 from coming off the pins 410. The limit of movement of the movable member 412 toward the housing 404 is defined by a stopper 426 which is integrally formed with the projecting member 408. In the figure, reference numeral 428 denotes a positioning pin which positions the projecting member 408 relative to the housing 404. In the figure, the shoe 402, indicated at two-dot chain line, is positioned at the most advanced position thereof.

Two guide rollers 430, 432 which cooperate with each other to guide the polishing tape 70 are attached to the projecting member 408, such that each of the guide rollers 430, 432 is rotatable and is fixed in position. The two guide rollers 430, 432 are provided on both sides of the shoe 402 in the lengthwise direction of the polishing tape 70. Therefore, the polishing tape 70 is fed from a supply reel 94 to a take-up reel 92 via a guide roller 436 inside the cartridge 400, the guide roller 432 outside the cartridge 400, the shoe 402, the guide roller 430, and a guide roller 434 inside the housing 400. In the figure, reference numerals 440, 442 denote respective tape guides which cooperate with each other to prevent the polishing tape 70 from being fed along an actual path largely deviated from a correct path.

In a cartridge 500 shown in FIG. 14, a shoe 502 is attached to a movable member 504 such that the shoe 502 is fixed in position. A guide 506 extends from the movable member 504 in a direction away from the shoe 502. The guide 506 is supported by a housing 508 of the cartridge 500 via a linear bearing 510, such that the guide 506 is movable in an axial direction thereof. An axis line of the guide 506 coincides with the movable axis line $L_M$. The housing 508 includes a projecting portion 512 which projects toward a cam portion 12. A pair of side plates 514, 514 are fixed to the projecting portion 512, such that each of the two side plates 514, 514 extends while taking such a posture that the each side plate 514 is perpendicular to a rotation axis line of a camshaft 10, and such that the two side plates 514, 514 are spaced from, and opposed to, each other. Each side plate 514 has a generally U-shaped configuration opening toward the cam portion 12. The movable member 504 is provided between the two side plates 514, 514, with respective clearances being left between the movable member 504 and the two plates 514, 514.

A coil spring 518 is provided between the movable member 504 and the housing 508, and biases the movable member 504 in a direction toward the cam portion 12. The limit of movement of the movable member 504 toward the housing 508 is defined by butting of a stopper 520 against the housing 508, and the limit of movement of the movable member 504 away from the housing 508 is defined by a pair of spring pins 522 (stopper members) opposite ends of each of which are supported by the two side plates 514, 514. In the figure, the limit of movement of the movable member 504 toward the housing 508 (i.e., the most retracted position of the shoe 502) is indicated at two-dot chain line "1", and the limit of movement of the movable member 504 away from the housing 508 (i.e., the most advanced position of the shoe 502) is indicated at two-dot chain line "2". Thus, the shoe 502 can be retracted into the inner space of the projecting portion 512 of the housing 508. The rotation of the movable member 504 about the movement axis line $L_M$ is inhibited by butting of the movable member 504 against the two side plates 514, 514. Two guide rollers 526, 528 which cooperate with each other to guide the polishing tape 70 are attached to the projecting portion 512, such that each of the guide rollers 526, 528 is rotatable and is fixed in position.

The description provided by reference to FIGS. 13 and 14 relates to the cases where two sorts of cartridges are used for switching between the state in which the rolling of a press member is inhibited and the state in which the rolling of the press member is allowed. However, it is possible to use a single sort of cartridge in which a press member is switched between those two states. For example, the linear bearing 252, shown in FIG. 2, may be modified to be of a type (e.g., an electro-magnet type) in which the linear bearing 252 is switchable between a state in which the linear bearing 252 applies a magnetic force to the guide 251, thereby attracts the guide 251, and thereby inhibits the rotation of the guide 251, and a state in which the linear bearing 252 allows the rotation of the guide 251.

While the present invention has been described in detail in its preferred embodiments by reference to the drawings, it is to be understood that the present invention may be embodied with other changes and improvements that may occur to one skilled in the art without departing from the appended claims.

What is claimed is:

1. An apparatus for polishing a workpiece, comprising:

a press member which is pressed, while the workpiece is rotated, against a back surface of a polishing tape to press the polishing tape against a target surface of the workpiece, wherein each portion of a press surface of the press member that presses the back surface of the polishing tape is located on a parallel plane which is parallel to a contact plane that contacts the target surface of the workpiece and which is distant from the contact plane by a thickness of the polishing tape on one of opposite sides of the contact plane that is opposite to the other side thereof on which the workpiece is located, or located on one of opposite sides of the parallel plane that is opposite to the other side thereof on which the workpiece is located; and a holding portion which holds the press member, wherein the holding portion includes a first device which holds the press member such that the press member is rollable about a rolling axis line which crosses a rotation axis line about which the workpiece is rotated and the holding portion further including a second holding device which holds the press member such that the press member is movable relative to the holding portion along a movement axis line which crosses the rotation axis line of the workpiece.

2. An apparatus according to claim 1, wherein the rolling axis line is substantially parallel to a straight line which contacts the press surface of the press member, at a position corresponding to a contact position where the polishing tape contacts the workpiece, and which perpendicularly crosses over the rotation axis line of the workpiece in a three-dimensional space.

3. An apparatus according to claim 1, wherein the rolling axis line is located at a position about which, during the polishing of the workpiece, a moment which rolls the press member to follow the workpiece is produced by a force which is exerted by the workpiece to the press member.

4. An apparatus according to claim 1, wherein the second holding device includes a rotation preventing mechanism which prevents the press member from rotating about an axis line which crosses the rolling axis line.

5. An apparatus according to claim 1, further including a biasing device which biases the press member toward the workpiece.

6. An apparatus according to claim 1, wherein the press member is held by the holding portion via a cartridge which is detachably attached to the holding portion, and the second holding device holds, on the cartridge, the press member such that the press member is movable relative to the cartridge.

7. An apparatus according to claim 1, wherein the press surface of the press member is curved convexly toward the workpiece as viewed in a widthwise direction of the polishing tape.

8. An apparatus for polishing a workpiece, comprising:

a press member which is pressed, while the workpiece is rotated, against a back surface of a polishing tape to press the polishing tape against a target surface of the workpiece, wherein each portion of a press surface of the press member that presses the back surface of the polishing tape is located on a parallel plane which is parallel to a contact plane that contacts the target surface of the workpiece and which is distant from the contact plane by a thickness of the polishing tape on one of opposite sides of the contact plane that is opposite to the other side thereof on which the workpiece is located, or located on one of opposite sides of the parallel plane that is opposite to the other side thereof on which the workpiece is located; and a holding portion which holds the press member wherein the holding portion includes a holding device which holds the press member such that the press member is rollable about a rolling axis line which crosses a rotation axis line about which the workpiece is rotated and wherein the rolling axis line substantially coincides with a straight line which contacts the press surface of the press member, at a position corresponding to a contact position where the polishing tape contacts the workpiece, and which crosses over the rotation axis line of the workpiece in a three-dimensional space.

9. An apparatus according to claim 8 wherein the press surface of the press member is one which straightly extends along the parallel plane, and the rolling axis line coincides with a centerline of the press surface that extends in a direction in which the polishing tape extends.

10. An apparatus for polishing a workpiece, comprising:

a press member which is pressed, while the workpiece is rotated, against a back surface of a polishing tape to press the polishing tape against a target surface of the workpiece, wherein each portion of a press surface of the press member that presses the back surface of the polishing tape is located on a parallel plane which is parallel to a contact plane that contacts the target surface of the workpiece and which is distant from the contact plane by a thickness of the polishing tape on one of opposite sides of the contact plane that is opposite to the other side thereof on which the workpiece is located, or located on one of opposite sides of the parallel plane that is opposite to the other side thereof on which the workpiece is located;

a holding portion which holds the press member, wherein the holding portion includes a holding device which holds the press member such that the press member is rollable about a rolling axis line which crosses a rotation axis line about which the workpiece is rotated; and a pair of tape-support portions which contact and support the polishing tape, at two positions between which the press member is located, and are moved with the press member.

11. An apparatus according to claim 10, wherein the pair of tape-support portions include a pair of guide rollers each of which is freely rotatable.

12. An apparatus according to claim 10, wherein the pair of tape-support portions include a pair of stationary contact portions each of which is fixed in position.

13. An apparatus for polishing a workpiece, comprising:

a press member which is pressed, while the workpiece is rotated, against a back surface of a polishing tape to press the polishing tape against a target surface of the workpiece, wherein each portion of a press surface of the press member that presses the back surface of the polishing tape is located on a parallel plane which is parallel to a contact plane that contacts the target surface of the workpiece and which is distant from the contact plane by a thickness of the polishing tape on one of opposite sides of the contact plane that is opposite to the other side thereof on which the workpiece is located, or located on one of opposite sides of the parallel plane that is opposite to the other side thereof on which the workpiece is located; and a holding portion which holds the press member, wherein the holding portion includes a holding device which holds the press member such that the press member is rollable about a rolling axis line which crosses a rotation axis line about which the workpiece is rotated, and wherein the press surface of the press member is curved convexly toward the workpiece as viewed in a lengthwise direction of the polishing tape.

14. An apparatus for polishing a workpiece, comprising:

a press member which is pressed, while the workpiece is rotated, against a back surface of a polishing tape to press the polishing tape against a target surface of the workpiece, wherein each portion of a press surface of the press member that presses the back surface of the polishing tape is located on a parallel plane which is parallel to a contact plane that contacts the target surface of the workpiece and which is distant from the contact plane by a thickness of the polishing tape on one of opposite sides of the contact plane that is opposite to the other side thereof on which the workpiece is located, or located on one of opposite sides of the parallel plane that is opposite to the other side thereof on which the workpiece is located; and a holding portion which holds the press member, wherein the holding portion includes a holding device which holds the press member such that the press member is rollable about a rolling axis line which crosses a rotation axis line about which the workpiece is rotated, and wherein the press member is held by the holding portion via a cartridge which is detachably attached to the holding portion, and the holding device holds, on the cartridge, the press member such that the press member is rollable relative to the cartridge.

15. An apparatus for polishing a workpiece, comprising:

a press member which is pressed, while the workpiece is rotated, against a back surface of a polishing tape to press the polishing tape against a target surface of the workpiece, wherein each portion of a press surface of the press member that presses the back surface of the polishing tape is located on a parallel plane which is parallel to a contact plane that contacts the target surface of the workpiece and which is distant from the contact plane by a thickness of the polishing tape on one of opposite sides of the contact plane that is opposite to the other side thereof on which the workpiece is located, or located on one of opposite sides of the parallel plane that is opposite to the other side thereof on which the workpiece is located;

a holding portion which holds the press member, wherein the holding portion includes a holding device which holds the press member such that the press member is rollable about a rolling axis line which crosses a rotation axis line about which the workpiece is rotated;

a workpiece rotating device which rotates the workpiece about the rotation axis line; and a tape holding device which holds the polishing tape and which includes (a) the holding portion, (b) a cartridge which is detachably attached to the holding portion and which holds the polishing tape at a position opposed to the target surface of the workpiece, and (c) the press member which is held by the cartridge and which presses the back surface of the polishing tape and thereby presses the polishing tape against the target surface of the workpiece.

16. A method of polishing a workpiece, comprising the steps of:

rotating the workpiece while pressing a press member against a back surface of a polishing tape and thereby pressing the polishing tape against a target surface of the workpiece, an angle defined by the target surface of the workpiece and a rotation axis line of the workpiece changing in a direction in which the target surface continues, each portion of a press surface of the press member that presses the back surface of the polishing tape being located on a parallel plane which is parallel to a contact plane that contacts the target surface of the workpiece and which is distant from the contact plane by a thickness of the polishing tape on one of opposite sides of the contact plane that is opposite to the other side thereof on which the workpiece is located, or located on one of opposite sides of the parallel plane that is opposite to the other side thereof on which the workpiece is located, and causing, during the polishing of the workpiece, the press member to be rolled about a rolling axis line which crosses the rotation axis line of the workpiece, so that the press member follows the target surface of the workpiece.

17. A method according to claim 16, wherein the press member is rolled about the rolling axis line relative to a holding portion which holds the press member.

18. A method according to claim 17, wherein the press member is rolled about the rolling axis line relative to the holding portion, while the press member is moved relative to the holding portion along a movement axis line which crosses the rotation axis line of the workpiece.

* * * * *